US005090875A

United States Patent [19]

Aikawa et al.

[11] Patent Number: 5,090,875

[45] Date of Patent: Feb. 25, 1992

[54] FLUID COMPRESSOR

[75] Inventors: Eiichi Aikawa, Yokohama; Takayoshi Fujiwara, Kawasaki; Hisanori Honma; Yoshinori Sone, both of Yokohama, all of Japan

[73] Assignee: Kabushiki Kaisha Toshiba, Kawasaki, Japan

[21] Appl. No.: 549,129

[22] Filed: Jul. 6, 1990

[30] Foreign Application Priority Data

Sep. 8, 1989 [JP] Japan ..... 1-231413
Sep. 8, 1989 [JP] Japan ..... 1-233411

[51] Int. Cl.[5] ..... F04C 18/16
[52] U.S. Cl. ..... 417/356; 418/220
[58] Field of Search ..... 417/356; 418/220

[56] References Cited

U.S. PATENT DOCUMENTS 2,290,137 7/1942 Aldridge .
2,401,189 5/1946 Quiroz .
4,871,304 10/1989 Iida et al. .
4,872,820 10/1989 Iida et al. ..... 417/356 X
4,875,842 10/1989 Iida et al. ..... 417/356 X

FOREIGN PATENT DOCUMENTS 0301273 2/1989 European Pat. Off. .
3830746 3/1989 Fed. Rep. of Germany .
64-36990 2/1989 Japan .

*Primary Examiner*—Gerald A. Michalsky
*Attorney, Agent, or Firm*—Cushman, Darby & Cushman

[57] ABSTRACT

A fluid compressor includes a closed case and a cylinder which is arranged in the case and has two opposite ends. A columnar rotating rod is located in the cylinder to be eccentric thereto, and rotatable along with the cylinder. The rod has a spiral groove on the outer circumferential surface thereof, and a spiral blade is fitted in the groove to divide the space between the rod and the cylinder into a plurality of operating chambers. The ends of the cylinder are rotatably supported by first and second bearings. The first bearing is secured to the casing. A drive unit for rotating the cylinder and rod includes a rotor fixed to the cylinder. The rotor has the center of gravity which is apart from the middle of the cylinder in its axial direction toward the first bearing.

9 Claims, 2 Drawing Sheets

FLUID COMPRESSOR

BACKGROUND OF THE INVENTION

1. Field of the Invention

The present invention relates to a fluid compressor, and more particularly, to a compressor for compressing refrigerant gas in a refrigeration cycle, for example.

2. Description of the Related Art

An example of a fluid compressor is shown in U.S. Pat. No. 4,875,842 to applicants of the present application. This type of compressor comprises a closed casing, and a compressor unit and a motor unit both housed in the closed casing. The motor unit has a stator fixed to the inner surface of the casing, and a rotor arranged within the stator coaxially therewith.

The compressor unit has a cylinder fixed coaxially within the rotor and rotated integrally with the rotor. A piston is rotatably arranged within the cylinder such that the piston is eccentric in respect to the axis of the cylinder. A spiral groove is formed on the outer circumferential surface of the piston, extending from one end of the piston to the other end thereof. The pitches of the spiral groove are gradually reduced with distance from the suction side of the cylinder towards the discharge side thereof. A spiral blade having a suitable elasticity is fitted in the spiral groove.

The space defined between the cylinder and the piston is divided into a plurality of operating chambers by means of the aforementioned blade. The capacities of the operating chambers are gradually reduced with distance from the suction side of the cylinder towards the discharge side thereof. When the cylinder and the piston are rotated by the motor unit in synchronous with each other, refrigerant gas in the refrigeration cycle is introduced into the operating chambers through the suction end of the cylinder. The sucked gas is gradually compressed while being transferred to the discharge end of the cylinder. The highly pressurized gas is discharged from the discharge end of the cylinder into the closed casing.

The suction-side end portion of the cylinder i rotatably supported by a main bearing secured to the inner surface of the casing. The discharge-side end portion of the cylinder is engaged with a sub-bearing. The sub-bearing is arranged to be movable in the radial direction of the cylinder in relation to the casing. Namely, the cylinder is substantially cantilevered by the main bearing.

The rotor of the motor unit is secured on the middle of the cylinder in its axial direction. The center of gravity of the motor unit, especially the center of gravity of the rotor, is situated at the middle of the cylinder in its axial direction. Thus, the center of gravity of the rotor is located a long distance from that surface of the main bearing which is secured to the casing.

As has been stated above, in the compressor having the cylinder supported substantially at its one end, the rotational movement characteristics are greatly influenced by the state of the supported cylinder, rotor, etc. When the respective members are not precisely aligned, for instance, when a deviation appears between the axis of the rotor and that of the cylinder or between the axis of the rotor and that of the stator, the cylinder and the rotor may whirl, with respect to an intersection between the fixed surface of the main bearing and the center axis of the cylinder. In particular, when the center of gravity of the rotor is greatly separated from the secured surface of the main bearing, as in the case of the above-described compressor, such whirling of the cylinder and rotor is worsened. As a result, vibration and noise of the compressor increases, and the frictional loss at the sliding portion of the bearing is considerably increased, thereby lowing the operation efficiency of the compressor. Furthermore, the rotor and the stator may contact and damage each other.

SUMMARY OF THE INVENTION

The present invention has been made in consideration of the above problems, and its object is to provide a fluid compressor wherein vibration and noise are reduced, a frictional loss of a bearing section is small, and high reliability and durability can be ensured.

In order to achieve the above object, with a fluid compressor of this invention, a rotor in a motor unit is secured to a cylinder such that the center of gravity of the rotor is apart from the middle of the cylinder in its axial direction toward the main bearing.

With this structure, the center of gravity of a rotational body including the rotor is made close to the secured surface of the main bearing. The supporting point of the whirling of the rotational body exists on the secured surface of the main bearing. Therefore, the whirling of the rotational body can be reduced.

According to a preferred embodiment of the present invention, the rotor is arranged such that the center of gravity of the rotor is situated within the main bearing and on the center axis of the cylinder. With this structure, the whirling of the rotational body can be further reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 4 show a fluid compressor according to an embodiment of the present invention, in which:

FIG. 1 is a longitudinal-sectional view showing the overall structure of the compressor;

FIG. 2 is an enlarged sectional view of the part including a main bearing;

FIG. 3 is a side view of a rotating rod; and

FIG. 4 is a side view of a blade.

DETAILED DESCRIPTION OF THE PREFERRED EMBODIMENT

An embodiment of the present invention will now be described in detail with reference to the accompanying drawings.

Figure 1:
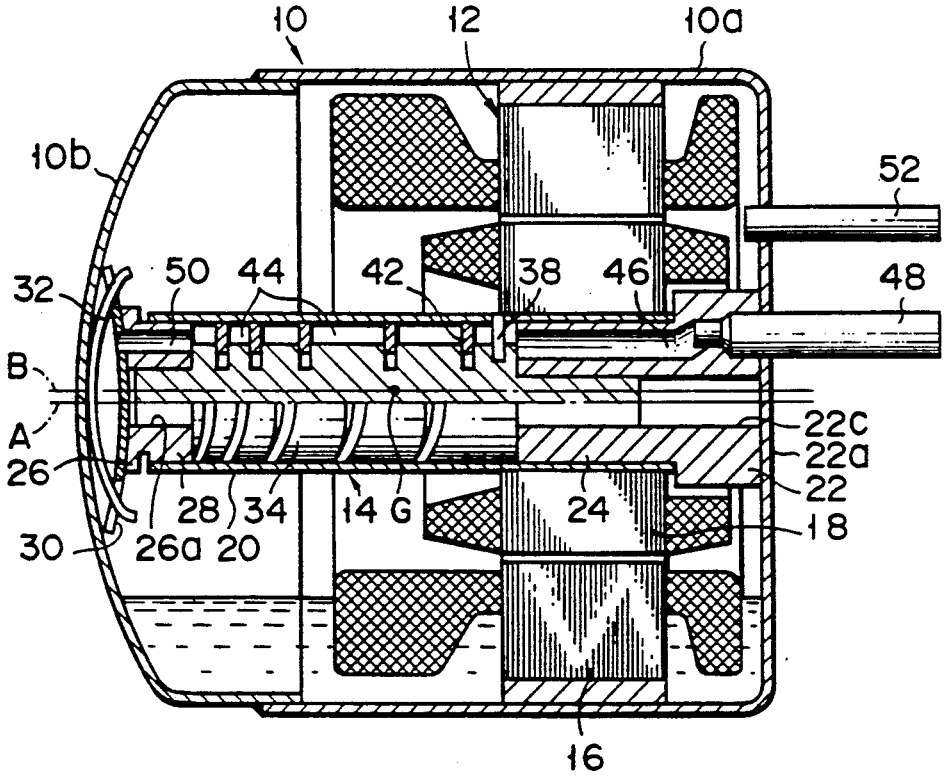

In the embodiment shown in FIG. 1, the present invention is applied to a closed type compressor for compressing refrigerant gas in a refrigeration cycle.

The compressor comprises a closed casing 10, an electric motor unit 12, and a compressor unit 14 driven by the motor unit 12, which are arranged within the casing 10. The casing 10 a cup-shaped large-diameter portion 10*a* a small-diameter portion 10*b*, the opening edges of which are coupled with each other.

Figure 2:
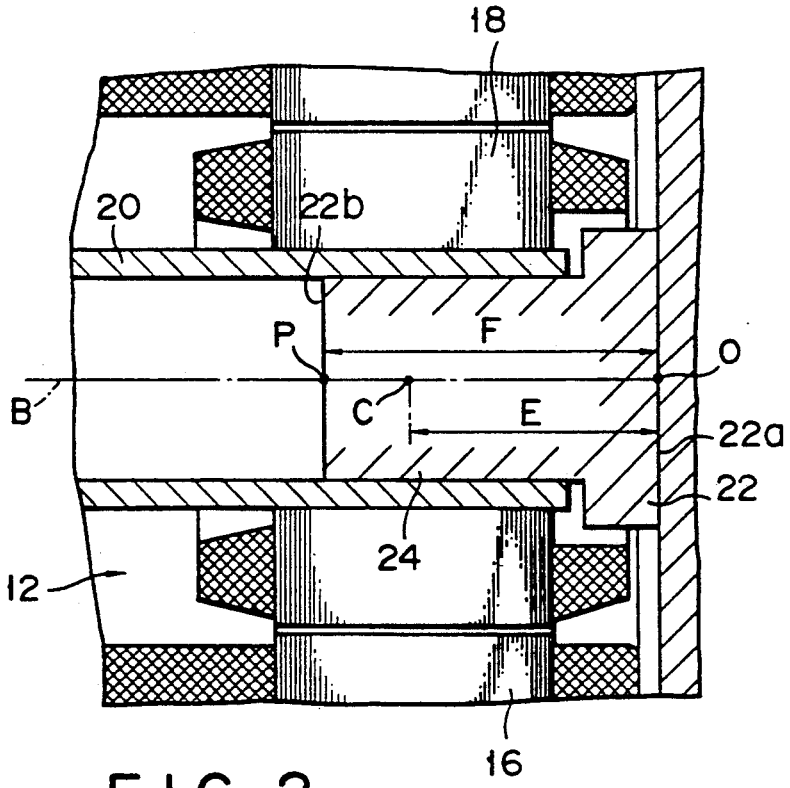

As shown in FIGS. 1 and 2, the motor unit 12 comprises an annular stator 16 fixed to the inner surface of the large-diameter portion 10*a* of the casing 10, and an annular rotor 18 coaxially arranged within the stator 16. The motor unit 12 is located about the axis of casing 10 towards the bottom wall of the large-diameter portion 10*a*. The rotor 18 is formed such that the center C of gravity thereof is situated at the middle of the center axis of the rotor.

The compressor unit 14 includes a cylinder 20 having a suction end portion and a discharge portion. The rotor 18 is coaxially fitted on the outer circumferential surface of the suction end portion of cylinder 20. The suction end portion (the right end portion in the figure) of the cylinder 20 is rotatably supported and hermetically sealed by a main bearing 22 secured to the inner surface of the large-diameter portion 10*a* of the casing 10. The bearing 22 has a cylindrical insertion portion 24 slidably inserted into the cylinder 20, proximal end surface 22*a* secured to the bottom wall of the large-diameter portion 10*a*, and a distal end surface 22*b* situated within the cylinder 20 and opposite the proximal end surface 22*a*.

A sub-bearing 26 is fitted into the discharge end portion (the left end portion in the figure) of the cylinder 20. The bearing 26 has a cylindrical insertion portion 28 slidably inserted into the discharge end portion of the cylinder 20. The insertion portion 28 hermetically seals the discharge end portion of the cylinder 20. The bearing 26 is supported on the casing 10 by means of an elastic support member 30 or a plate spring, so that it can move in the radial direction of the cylinder 10. Specifically, the support member 30 is engaged with an engage member 32, fixed to the bottom surface of the small-diameter portion 10*b* of the casing 10, so that the support member 30 can move in the radial direction of the cylinder 20. The support member 30 is engaged with the proximal-end surface of the bearing 26, thereby urging the bearing 26 towards the discharge end of the cylinder 20 and restricting the rotation of bearing 26 relative to the cylinder 20.

As has been stated above, the cylinder 20 and the rotor 18 are supported on one side thereof by means of the main bearing 22, and also they are supported by means of the bearings 22 and 26 coaxially with the stator 16.

The positional relationship between the rotor 18, cylinder 20, and main bearing 22 will now be described.

As shown in FIGS. 1 and 2, the rotor 18 is secured on the suction end portion of the cylinder 20. The center C of gravity of the rotor 18 is to one side of the middle G in the axis of the cylinder 20 towards the main bearing 22. In particular, in the present embodiment, the center C of gravity of the rotor 18 is situated within the main bearing 22, that is, on the center axis B of the cylinder 20 between the proximal end surface 22*a* and the distal end surface 22*b* of the bearing 22.

In one case an intersection between the center axis B of the cylinder 20 and the proximal end surface 22*a* of the main bearing 22 is set as a reference position O, and an intersection between the center axis B and the distal end surface 22*b* of main bearing 22 is set as a position P. In this case, the distance E between the reference position 0 and the center C of gravity of the rotor 18 is smaller than the distance F between the reference position 0 and the position P ($E<F$).

Figure 3:
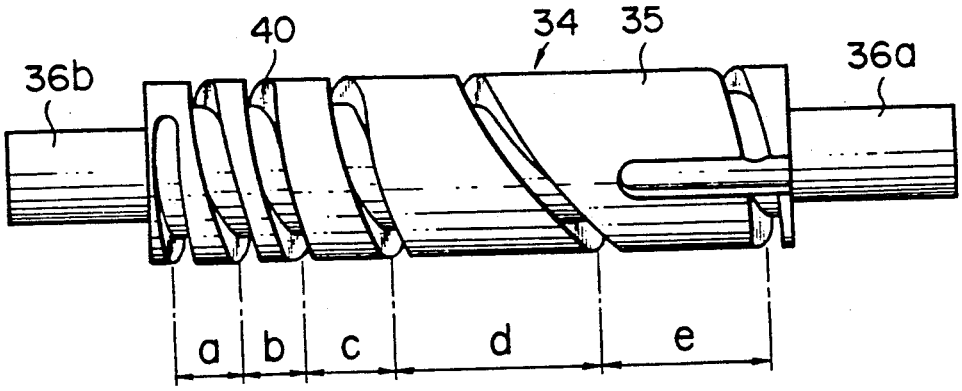

As shown in FIGS. 1 and 3, a rotating rod 34 serving as a rotating body is contained in the cylinder 20, extending in the axial direction of the cylinder 20. The rod 34 comprises a columnar rod body 35 having a diameter smaller than the inner diameter of the cylinder 20, and a pair of journal portions 36*a* and 36*b* extending coaxially from both ends of the body 35. The center axis A of the rod 34 is situated at eccentricity e from the center axis B of the cylinder 20, and part of the outer circumferential surface of the body 35 is in contact with the inner circumferential surface of the cylinder. The journal portions 36*a* and 36*b* are rotatably inserted in support holes 22*c* and 26*a* formed in the bearings 22 and 26, whereby the rotating rod 34 is rotatably supported by the bearings 22 and 26.

As shown in FIG. 1, an engaging groove is formed in the outer circumferential surface of the suction end portion of the rod body 35. A drive pin 38 projecting from the inner surface of the cylinder 20 is inserted into the engaging groove so as to be movable in the radial direction of the cylinder 20. Accordingly, when the motor unit 12 is energized to rotate the cylinder 20 integral with the rotor 18, the rotational force of the cylinder 20 is transmitted to the rotating rod 34 through the pin 38. Consequently, the rod 34 is rotated within the cylinder 20 while the outer circumferential surface of the rod 34 is partially in contact with the inner surface of the cylinder 20.

As is shown in FIGS. 1 and 3, a spiral groove 40 is formed on the outer circumferential surface of the rod body 35, and extends between both ends of the rod body 35. The pitches of the groove 40 gradually become narrower with distance from the suction end of the cylinder 20 towards the discharge end thereof. The depth and width of the groove 40 is substantially constant for the entire length of the groove. In FIG. 3, the pitches of the turns of the groove 40 are denoted by a to e, from the discharge end of the cylinder 20 to the suction end thereof.

Figure 4:
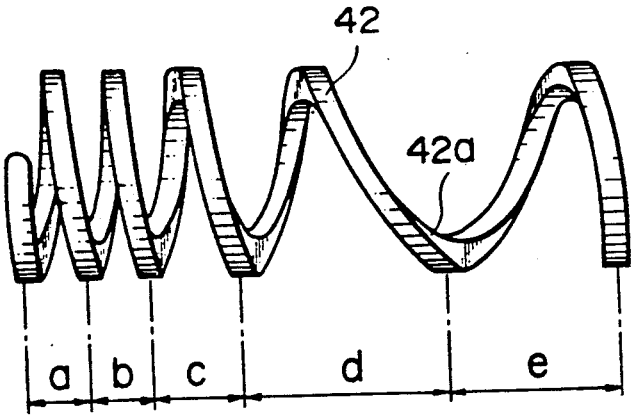

A spiral blade 42, shown in FIG. 4, is fitted in the groove 40. Each part of the blade 42 is movable in the radial direction of the rod 34 along the groove 40. The outer circumferential surface of the blade 42 is brought into close contact with the inner surface of the cylinder 20.

The thickness of the blade 42 is substantially equivalent to the width of the groove 40 over the entire length. The width of each part of the blade 42 in the radial direction is substantially equal to the depth of the groove 40. The blade 42 is formed, in advance, such that the pitches thereof gradually decrease with distance from on end of the blade to the other end thereof, before the blade 24 is to be fitted in the groove 40. The pitches of the blade 42 and the shape of the side surfaces 40*a* of the blade correspond to those of the groove 40. Namely, the pitches a to e of the turns of the blade 40 from the left end to the right end are substantially equal to the pitches of the turns of the groove 40 from the discharge end to the suction end thereof. Further, the angle and shape of each part of the blade 42 correspond to those of the corresponding part of the groove 40.

The blade 42 is formed, for example, by means of injection molding, with use of a mold having the same shape as the rotational rod with the spiral groove.

As is shown in FIG. 1, the space defined between the inner surface of cylinder 20 and the outer circumferential surface of the rod body 35 is divided by the blade 42 into a plurality of operating chambers 44, which are aligned in the axial direction of the cylinder 20. Each operating chamber 44, which is defined by two adjacent turns of the blade 42, is substantially in the form of a crescent extending along the blade from a contact portion between the rod body 35 and the inner surface of the cylinder to the next contact portion. The capacities of the operating chambers 44 are reduced gradually with distance from the suction end of the cylinder 20 toward the discharge end thereof.

A suction hole 46 is formed in the bearing 22 supporting the suction end portion of the cylinder 20. The suction hole 46 extends in the axial direction of the cylinder 20. One end of the suction hole 46 is open into the suction end portion of the cylinder 20, and the other end thereof is connected to a suction tube 48 of the refrigeration cycle. The bearing 26 supporting the discharge end portion of the cylinder 20 has a discharge hole 50. One end of the hole 50 is open into the discharge end portion of cylinder 20, and the other end thereof is open to the inside of the casing 10 via the support member 30. The discharge hole 50 may be formed in the cylinder 20.

A lubrication oil is stored in the bottom of the casing 10. In FIG. 1, reference numeral 52 denotes a discharge tube which communicates with the inside of the casing 10.

The operation of the compressor having the above-described structure will be described.

When the motor unit 12 is energized, the rotor 18 along with the cylinder 20 rotates, and at the same time the rotating rod 34 rotates while its outer circumferential surface is partially in contact with the inner surface of the cylinder 20. Since the blade 3 rotates with its outer circumferential surface put in contaci with the inner surface of the cylinder 20, the respective portions of the blade 42 gradually are pushed into the groove 40 as they approach the contact portion between the outer circumferential surface of the rod body 35 and the inner surface of the cylinder 20, and emerge from the groove 40 as they go away the contact portion. When the compressor unit 14 is operated, refrigerant gas is sucked into the cylinder 20 through the suction tube 48 and the suction hole 46. In accordance with the rotation of the rotating rod 34, the sucked gas is conveyed from the suction end of the cylinder 20 to the discharge end thereof through the operating chambers 44. As has been described above, the capacities of the operating chambers 44 decrease gradually with distance from the suction end of the cylinder 20, thus, the refrigerant gas is gradually compressed as it is conveyed toward the discharge end of the cylinder. The compressed refrigerant gas is discharged into the inside of the casing 10 through the discharge hole 50 formed in the bearing 26. Further, the gas is returned to the refrigeration cycle through the discharge tube 52.

According to the fluid compressor having the above-described structure, the rotor 18 of the motor unit 12 is secured to the cylinder 20 such that the center of gravity of the rotor 18 is set apart from the middle of the axis of the cylinder 20 toward the main bearing 22. In particular, in this embodiment, the center C of gravity of the rotor 18 is situated within the main bearing 22. Thus, the center C of gravity of the rotor 18 is close to the reference point O on the proximal end surface 22*a* of the main bearing 22, and the angular moment acting about the reference point O upon the rotor 18, cylinder 20 and main bearing 22 is remarkably reduced.

Accordingly, with the compressor, the whirling of the rotor, cylinder and main bearing can be reduced, which occurs owing to the characteristic frequency of the rotor 18, the displacement between the axes of the rotor 18 and the cylinder 20, the displacement between the axes of the rotor and the main bearing 22, the displacement between the axes of the rotor and the stator 16, etc. As a result, the vibration of the compressor in operation and the noise due to the vibration can be reduced. In addition, frictional loss due to the whirling of the rotor, cylinder and main bearing is decreased between the cylinder and the main bearing and between the rotating rod and the main bearing. Therefore, the operation efficiency and reliability of the compressor can be improved.

According to this embodiment, before the blade 42 is fitted in the spiral groove 40 of the rotating rod 34, the blade 42 is previously formed so as to have the same shape and pitches as those of the groove 40. The advantages attained by this feature will be stated.

In a conventional compressor, the blade is formed in a shape which is relatively easily obtained (e.g. with equal pitches), and then the blade is fitted into a spiral groove in the rotating rod. More specifically, the blade, having the pitches and shape different from those of the spiral groove, is extended in its axial direction and elastically deformed so as to accord with the pitches of the spiral groove and, in this state, the blade is fitted in the spiral groove of the rotating rod. However, if the blade is elastically deformed in its axial direction to a considerable degree, the shape of the respective portions of the blade do not accord with the corresponding portions of the spiral groove. Thus, the respective portions of the blade are not allowed to move in the groove smoothly. As a result, it is conventionally necessary to employ a material for the blade, which is relatively soft and has sufficient elasticity.

When the blade is formed of an excessively soft material, it deforms freely and largely in accordance with the pressure acting on each turn and with the wall shape of the groove. Thus, the blade easily moves in the circumferential direction of the spiral groove. There is a concern that the end of the blade abuts against the end of the groove or the blade is removed from the groove. In such a case, either or both the blade and groove are deformed or damaged, and the reliability and durability of the compressor are deteriorated. Further, it is very difficult to select a suitable material for the blade in consideration of the above problems.

By contrast, according to the present embodiment, the blade 42 is previously formed to have the same shape and pitches as those of the spiral groove 40 of the rotating rod 34, as has been stated above. Therefore, it is not necessary to elastically deform the blade in its axial direction, and the blade can be easily fitted in the spiral groove. In addition, compared to the conventional compressor, the material for the blade can be selected relatively freely, and a relatively hard material having less elasticity may be employed. Thus, the blade is prevented from largely deforming in accordance with a shape for the groove, and also the blade is prevented from moving in the circumferential direction of the groove. The end of the blade is prevented from contacting the end of the groove, and the blade is not removed from the groove. The deformation and damage of the groove and blade can be prevented. Therefore, the reliability and the durability of the compressor can be improved.

The present invention is not limited to the above-described embodiment, and various modifications may be made within the scope of the subject matter of the present invention. For instance, the present invention can be applied not only to compressors for a refrigeration cycle, but also to compressors for other purposes. In the above embodiment, the proximal end surface of the main bearing is secured directly to the inner surface of the casing. However, it is possible to provide an intermediate member such as a seat between the proximal end surface of the bearing and the inner surface of the casing.

Additional advantages and modifications will readily occur to those skilled in the art. Therefore the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A fluid compressor comprising:

a closed casing;

a cylinder arranged within the casing and having a suction end and a discharge end;

a columnar rotating body located in the cylinder to extend in an axial direction of the cylinder and be eccentric thereto, and rotatable synchronously with the cylinder while part of the rotating body is in contact with an inner surface of the cylinder, said rotating body having a spiral groove on an outer circumferential surface thereof, said groove having pitches gradually narrowing with distance from the suction end of the cylinder;

a spiral blade fitted in said groove to be slidable, substantially in a radial direction of the cylinder, said blade having an outer circumferential surface closely in contact with the inner surface of the cylinder, and dividing a space defined between the inner surface of the cylinder and the outer circumferential surface of the rotating body into a plurality of operating chambers;

first and second bearings for rotatably supporting both ends of the cylinder and also rotatably supporting opposite ends of the rotating body, said first bearing being secured to said closed casing; and drive means for synchronously rotating said cylinder and said rotating body so as to successively transport a fluid introduced from the suction end of the cylinder into the cylinder toward the discharge end of the cylinder through the operating chambers, and discharging the fluid to the outside from the discharge end of the cylinder, said drive means having a rotor secured to the cylinder and rotating integrally with the cylinder, said rotor being located so that at least a portion of the rotor which is in contact with the cylinder overlaps the first bearing in the axial direction of the cylinder.

2. A fluid compressor according to claim 1, wherein said rotor is secured to the outer circumferential surface of the cylinder, and the center of the gravity of the rotor is located on the center axis of the cylinder.

3. A fluid compressor according to claim 1, wherein the center of the gravity of the rotor is located within the first bearing and on the center axis of the cylinder.

4. A fluid compressor according to claim 1, wherein said first bearing has an insertion portion inserted in the end portion of the cylinder, a secured surface secured to the casing, and a distal end surface located inwards of the cylinder, a center of gravity of the rotor being situated between said secured surface and said distal end surface of the rotor and on the center axis of the cylinder.

5. A fluid compressor according to claim 1, wherein said second bearing is movable in the radial direction of the cylinder, in relation to the closed casing.

6. A fluid compressor according to claim 1, wherein said drive means includes a stator secured to an inner surface of the closed casing and arranged coaxially with said rotor on the outside of the rotor, said stator and said rotor constituting a motor unit.

7. A fluid compressor according to claim 1, wherein said blade is formed in a spiral in advance, such that the blade has the same pitches as those of said spiral groove.

8. A fluid compressor comprising:

a closed casing;

a cylinder arranged within the casing and having a suction end and a discharge end;

a columnar rotating body located in the cylinder to extend in an axial direction of the cylinder and be eccentric thereto, and rotatable synchronously with the cylinder while part of the rotating body is in contact with an inner surface of the cylinder, said rotating body having a spiral groove on an outer circumferential surface thereof, said groove having pitches gradually narrowing with distance from the suction end of the cylinder;

a spiral blade fitted in said groove to be slidable, substantially in a radial direction of the cylinder, said blade having an outer circumferential surface closely in contact with the inner surface of the cylinder, and dividing the space defined between the inner surface of the cylinder and the outer circumferential surface of the rotating body into a plurality of operating chambers;

first and second bearings for rotatably supporting both ends of the cylinder and also rotatably supporting opposite ends of the rotating body, said first bearing being secured to said closed casing; and drive means for synchronously rotating said cylinder and said rotating body so as to successively transport a fluid introduced from the suction end of the cylinder into the cylinder toward the discharge end of the cylinder through the operating chambers, and discharging the fluid to the outside from the discharge end of the cylinder, said drive means having a rotor secured to the cylinder and rotating integrally with the cylinder, said rotor having a center of gravity located within the first bearing and on the center axis of the cylinder.

9. A fluid compressor according to claim 8, wherein said first bearing has an insertion portion inserted in an end portion of the cylinder, a secured surface secured to the casing, and a distal end surface located inwards of the cylinder, the center of gravity of the rotor being located between said secured surface and said distal end surface of the rotor and on the center axis of the cylinder.

* * * * *